US005307580A

United States Patent [19]

Farmer

[11] Patent Number: 5,307,580

[45] Date of Patent: May 3, 1994

[54] DISPLAY SIGN

[76] Inventor: Kenneth R. Farmer, 2397 Church Rd., Smyrna, Ga. 30080

[21] Appl. No.: 926,652

[22] Filed: Aug. 10, 1992

[51] Int. Cl.[5] ..... G09F 15/00

[52] U.S. Cl. ..... 40/606; 248/156

[58] Field of Search ..... 40/606, 607, 586; 16/111 R, DIG. 13, 120; 248/156, 545, 68.1

[56] References Cited

U.S. PATENT DOCUMENTS

| | | | |
|---|---|---|---|
| 3,043,902 | 7/1962 | Klein | 24/339 |
| 4,173,086 | 11/1979 | Hempfling | 40/607 |
| 4,244,542 | 1/1981 | Mathews | 248/68.1 |
| 4,259,803 | 4/1981 | Sittler | 40/607 |
| 4,407,472 | 10/1983 | Beck | 24/339 |
| 4,658,527 | 4/1987 | Pingel | 49/606 |
| 4,660,310 | 4/1987 | Farmer | 40/607 |
| 4,885,860 | 12/1989 | Huenefeld | 40/606 |
| 4,894,937 | 1/1990 | Davis | 40/606 |
| 5,042,183 | 8/1991 | Kennedy | 40/607 |
| 5,050,828 | 9/1991 | Wolff | 248/156 |
| 5,103,582 | 4/1992 | Farmer | 40/606 |

*Primary Examiner*—Kenneth J. Dorner
*Assistant Examiner*—J. Silbermann
*Attorney, Agent, or Firm*—Wigman, Cohen, Leitner & Myers

[57] ABSTRACT

A safety display sign includes a wire post member having spaced apart wire legs extending from a rounded end portion. The wire legs extend through the channels of a corrugated polyethylene sign panel, and project therefrom a sufficient distance to permit secure fixation in the ground. An extruded polyethylene base member is provided with two slotted passages integrally formed at opposite side edges of the base member to receive and grip the wire legs in a unitary assembly which prevents the sign panel from sliding along the length of the wire legs. The polyethylene base is positioned along the length of the wire legs and is urged against the edge of the sign panel by the ground or other supporting surface to secure the sign panel at the top portion of the post.

18 Claims, 1 Drawing Sheet

DISPLAY SIGN

FIELD OF THE INVENTION

The present invention relates to display signs, and more particularly to a display sign in which a display panel is supported by a wire post in an upright position.

BACKGROUND OF THE INVENTION

Display sign assemblies of the prior art include vertical members to which a display sign panel is attached by rivets, threaded connections, staples, nails, adhesives, and the like. The vertical members may be wooden stakes or metal posts which are driven into the ground by hammer or mallet, or by application of body weight against a post cross-brace or other transverse bar member. When a wooden stake is used, the stake must be suitably sized and shaped to carry the combined load of the display sign panel and stake assembly and to absorb, without damage, considerable insertion force applied to the stake when the ground is dry, hard, or when the end of the stake has not been properly sharpened. Metal posts used for this type of display sign assembly often are fabricated of steel or aluminum members. In general, metal posts having U-shaped and T-shaped cross-sections are used to support one-sided display signs. Metal posts having a square cross-section may be used for securing two display signs mounted on opposite sides of the post.

Because of their generally rugged construction and considerable weight, the above-described display sign assemblies are cumbersome to transport from one installation site to the next and require considerable labor to install at the new site. Furthermore, the combined costs of manufacturing and materials for the aforementioned display signs generally prohibit a one-time use, thereby requiring retrieval and storage of the display sign when not in use, resulting in additional labor for disassembly and subsequent reassembly, and storage expenses.

Another problem with prior art display sign assemblies is the popular use of styrene plastic for the display sign panel. While styrene plastic provides good display characteristics, aging and weathering causes this material to become embrittled with greater susceptibility to breakage when impacted. Accordingly, display sign panels fabricated from styrene plastic must be replaced on a regular basis, resulting in yet additional material and labor expenses.

Typically, display sign assemblies, and especially those used to warn potential intruders that a residence is protected by a security system or to post real estate notices, are posted on residential lawns and other areas frequented by children, maintenance and utility workers, and other pedestrian traffic. Many of the prior art display sign assemblies include numerous sharp corners and ragged edges on the sign panels and in exposed locations about the upper end portions and periphery of the metal post or wooden stake to which the sign panel is affixed. Should a child run or fall against these sharp corners and ragged edges, serious injury to the child can result. This situation may be exacerbated in the case of styrene plastic panels which may have become embrittled, causing the panel to shatter into numerous sharp-edged fragments upon impact. To avoid possible injury to children and other individuals, such display sign assemblies are often posted near mail box posts, landscaping shrubbery or other out-of-the-way locations. However, this solution sometimes defeats the primary purpose of the sign which is intended to be located in the most visible place possible. In addition, the prior art security system and real estate signs are sometimes difficult to remove and replace for normal lawn maintenance, such as mowing and the like. Accordingly, it would be desirable to provide a display sign that is inexpensive to manufacture, easy to install, remove and replace, and is sufficiently resilient so as not to pose any safety hazard to children and others passing nearby, yet has the sturdy appearance of the prior art display signs described above.

OBJECTS AND SUMMARY OF THE INVENTION

It is therefore an object of the present invention to provide a display sign assembly which is strong, durable, lightweight, relatively inexpensive to manufacture, and which requires a minimum amount of physical exertion to assemble, transport, install, remove, or discard.

It is another object of the present invention to provide a display sign assembly having a safety-engineered flexible post designed to decrease the risk of serious injury to a child or other person upon impact with the installed sign.

It is a further object of the present invention to provide an inexpensive and rugged corrugated polyethylene display panel for use with security system and real estate notice display sign assemblies.

It is yet another object of the present invention to provide a display sign assembly which obviates the need for fasteners or fastener-securing tools, while providing a device for reliably securing the display panel to the post.

The present invention is directed to a display sign assembly of the type used to indicate the presence of an active security system or to provide a real estate notice. The assembly has a two-sided corrugated polyethylene sign panel which is supported by a U-shaped post member made of flexible steel wire. The two legs of the U-shaped post are inserted through channels in the corrugated sign panel from the top edge thereof in a generally vertical direction and project from the bottom edge of the panel a distance sufficient to permit the legs to be forced into the ground or other retention medium. The parallel channels are defined by the two sides of the sign panel and the spaced-apart webs which separate the sides. The legs of the U-shaped, steel wire post are guided and retained in the channels against lateral motion.

The projecting legs of the wire post are maintained in a spaced apart, parallel relationship by a base member extruded from a flexible plastic, such as polyethylene. The base gives the appearance of a rigid metal post, yet is sufficiently flexible so as to yield with the wire post member should a person, such as a child, accidentally run or fall against the sign. The base has ribs disposed along opposite edges of the longitudinal length thereof. Each rib has a passage with a cross-sectional shape and dimension substantially corresponding to that of the legs of the post and is slotted along the length thereof so as to receive and retain one of the wire legs of the post member.

When the base is installed over the legs and the legs are forced into the ground, the lower edge of the base contacts the ground and is compressed between the ground and the lower edge of the sign panel so that the latter is effectively captivated between the base and the U-shaped portion at the upper end of the wire post. In this manner, the sign panel is prevented from vertical movement along the legs of the wire post. The base is likewise prevented from vertical movement along the legs because it is captivated between the ground and the bottom of the sign panel.

According to the preferred embodiment of the present invention, after the sign panel has been inserted onto the wire post the legs are pressed transversely into the rib passages via the slots in the ribs. The base is then adjusted in an upward direction to urge the display panel into the desired uppermost vertical position against the U-shaped portion and the free ends of the legs are then forced into the ground. The polyethylene base features a black matte finish which, in the installed condition, conveys the appearance of a post having a solid metal construction.

Accordingly, the invention enables the speedy assembly and installation of a lightweight display sign assembly, and the disassembly, removal and replacement of one display panel for another therein as the need arises and without undue labor or expense. Alternatively, the display sign assembly may be readily removed, replaced, or discarded without heavy physical exertion, due to the light weight and relatively low cost of the assembly.

Furthermore, the upper U-shaped portion of the wire post provides an added important safety feature particularly applicable to installations adjacent those areas frequented by children.

With the foregoing and other objects, advantages, and features of the invention that will become hereinafter apparent, the nature of the invention may be more clearly understood by reference to the following detailed description of the invention, the appended claims, and to the several views illustrated in the drawings.

DETAILED DESCRIPTION OF THE INVENTION

Figure 1:
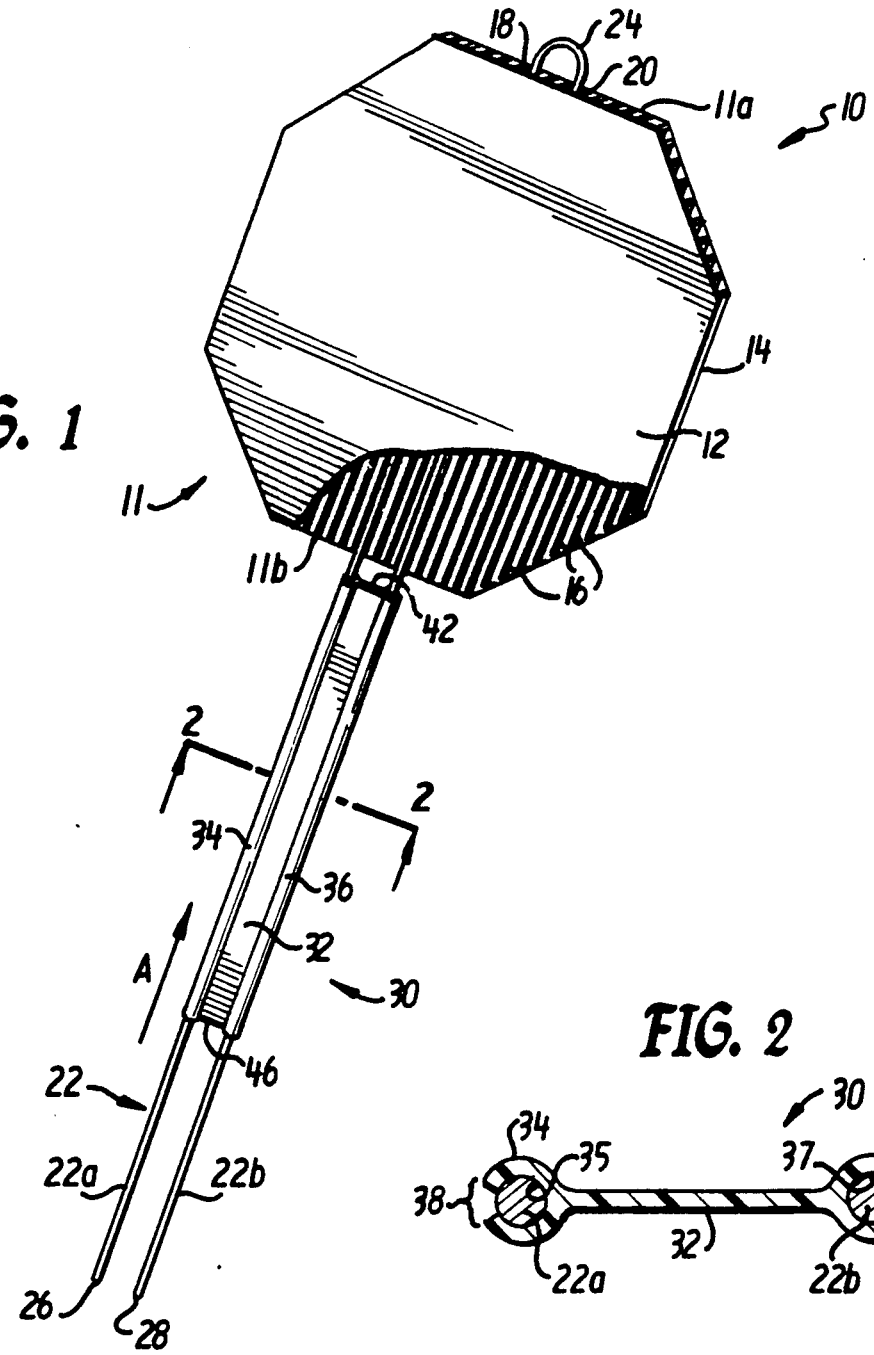
FIG. 1 is a perspective view, partly broken away, of the d sign assembly of the present invention showing the legs of the flexible steel wire post inserted through the corrugated polyethylene sign panel and extruded polyethylene base of the present invention.

Referring now in detail to the drawings wherein like parts are designated by like reference numerals throughout, there is illustrated in FIG. 1 a perspective view of the display sign assembly of the present invention which is designated generally by reference numeral 10. The display sign assembly 10 comprises a corrugated display panel 11 having a front planar face 12 and a rear planar face 14 held together in spaced apart, parallel orientation by a plurality of laterally extending interconnecting webs 16. The webs 16 are oriented in a substantially perpendicular orientation to the front panel 12 and the rear panel 14 and extend in a generally vertical direction relative to the installed orientation of the display sign assembly 10 to define at least two rectangular-shaped vertical channels 18, 20 which extend the vertical length of the display panel 11.

The corrugated polyethylene display panel 11 is a durable and inexpensive material suitable for cold and otherwise harsh climates, and is less susceptible to the aging and weathering problems known to prior art styrene plastic sheet material used for display sign purposes which are known to shatter into sharp fragments upon impact, especially in an embrittled condition. In addition, the corrugated polyethylene panel has an anticipated lifespan about 300 percent longer than styrene plastic, further adding to the desirability of this material for extensive and inexpensive outdoor use. Corrugated plastic material of the type which can be imprinted on both faces 12, 14 and configured in a particular display size and shape is available from Innopac Company of Irving, Tex. under the trade name COROPLAST®.

The display panel 11 is supported in an upright position by a wire post member 22 fabricated from commonly available and inexpensive galvanized ⅛ inch diameter steel stock. Alternatively, stainless steel or other strong, durable and flexible wire stock may be used to form the wire post of the present invention, as will become apparent to one skilled in the art to which this invention pertains. The wire member 22 is bent at its mid-length in a 180° angle to form a curved or rounded top portion 24 having a radius in the range of about ½ inch to 3 inches, and preferably about 1 inch. The resulting rounded shape of the top portion 24 provides an important safety feature by obviating the sharp corners and ragged edges of the posts of the prior art. Legs **22*a* and 22*b* extend from the top portion 24 in parallel relationship to form a double-legged post member terminating at the free ends 26, 28, respectively, of legs 22*a* and 22*b*. If desired, the free ends 26, 28 may be pointed to facilitate penetration of the legs into the ground. Although the legs 22*a*, 22*b*** may have any suitable length consistent with the size, weight and purpose of the sign, a preferred length is in the range of 30–36 inches.

The display sign 10 also comprises base member 30 which is cut from a plastic strip, preferably an extruded polyethylene strip. As best seen in the transverse cross-section of FIG. 2, the base member 30 comprises a central transverse web 32 and has a pair of ribs 34, 36 formed at the opposite side edges thereof. Each rib 34, 36 is provided with a longitudinal passage 35, 37 and a longitudinal slot 38, 40, respectively, and has a generally C-shaped configuration in which the leg members **22*a*, 22*b*** are snugly retained.

To assemble the display sign 10, the leg ends 26, 28 are inserted into the channels 18, 20 of the panel 11 at the uppermost edge thereof and are urged through panel 11 until the rounded top portion 24 of the wire member 22 engages the top edge **11*a* of the panel 11 with a snug fit against the webs 16**.

Figure 2:
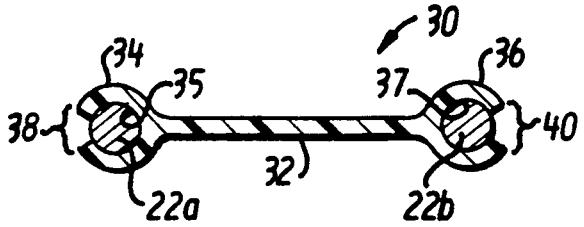
FIG. 2 is a cross-sectional view of the polyethylene base and flexible steel wire legs engaged therewith taken along line 2—2 of FIG. 1.

The base member 30 is then assembled to the legs **22*a*, 22*b* by positioning the base member between the legs and forcing the legs through the slots 38, 40 and into the passages 35, 37 of ribs 34, 36 (FIG. 2). It will be appreciated that the resiliency of the plastic material of the base member 30 will permit the web 32 as well as the ribs 34, 36 to flex and permit passage of the legs 22*a*, 22*b* through the slots 38, 40 and into the passages 35, 37. Preferably, the diameter of the passages 35, 37 as extruded is slightly smaller than the diameter of the legs 22*a*, 22*b*** so as to provide a snug, interference fit therebetween.

After the legs **22*a*, 22*b* have been installed in the base member 30 in the above-described manner, the base member 30 is slideably moved in the direction of arrow A until the top edge 42 of the base member 30 engages the bottom edge 11***b* of the display panel 11. Further urging of the base member 30 in the same direction causes the top edge 11*a* of the display panel 11 and the adjacent webs 16 to become firmly lodged against the top portion 24 of the wire member 22.

To install the display sign assembly 10, the assembled sign 10 is aligned in a generally perpendicular orientation with the ground or other appropriate support surface and the leg ends 26, 28 are driven into the ground by applying a force to the top portion 24 of the wire member 22. The force applied should be sufficient to cause the bottom edge 46 of the base member 30 to contact the ground thereby compressing the base member 30 between the ground and the lower edge 11*b* of the display panel 11. The display panel 11 will then be securely locked in an upright vertical position to the wire member 22. In this condition, the polyethylene base member 30, which preferably has a black matte finish, conveys the appearance of a solid post. An important feature of this invention is that the display panel 11 may be secured in an upright position on the post member 22 without the need for any fasteners or ancillary tools typically required of the prior art installations. Furthermore, the display panel 11 may be readily replaced with a new panel simply be reversing the above-described assembly procedure. The display sign assembly 10 may also be readily removed from a lawn for mowing and the like and replaced.

Figure 3:
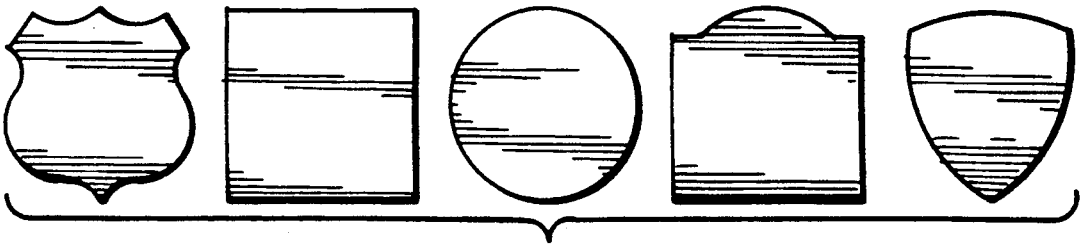
FIG. 3 a representative sampling of the various configurations of display sign panels that may be supported by the display sign assembly of the present invention.

Now referring to FIG. 3, the display panel 11 may be configured in any of the illustrated shapes and mounted according to the present invention. Those skilled in the art will appreciate that display panels having many other shapes, not shown in the drawings, may also be mounted according to the teachings of the present invention.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

I claim:

1. A display sign comprising:

sign panel constructed of corrugated sheet material having channels extending therethrough;

a one-piece post member having two leg members adapted to extend completely through a pair of said channels, said post member comprising an end portion integrally formed with said two leg members; and a base member having a pair of passages each adapted to receive and retain a portion of a respective leg member.

2. The display sign of claim 1, wherein said sign panel has upper and lower edges, said end portion being engagable with the upper edge of said panel when said leg members are inserted through said channels, said base member being engagable with the lower edge of said panel.

3. The display sign of claim 2, wherein said end portion is rounded to form a U-shape with said leg members.

4. The display sign of claim 1, wherein said base member is extruded polyethylene.

5. The display sign of claim 1, wherein said passages in said base member are in spaced parallel relation, said base member comprising a web member extending between said passages.

6. The display sign of claim 1, including slots in said base member intersecting said passages, said leg members being insertable into said passages via said slots.

7. The display sign of claim 1, wherein said passages and said leg members have complementary circular cross-sections transverse to the axes thereof.

8. The display sign of claim 1, wherein said post member comprises a round galvanized steel wire having a diameter of about ⅛ inch.

9. The display sign of claim 1, wherein said post member comprises a wire bent through 180° to form said two leg members and a rounded end portion, said leg members and rounded end portion having a U-shape.

10. The display sign of claim 1, wherein said base member comprises an elongated web having parallel side edges, ribs formed along said side edges, said passages being formed in said ribs, said base member being extruded in one piece from resilient plastic material.

11. The display sign of claim 10, including a slot formed in the ribs of said elongated web, each slot intersecting a respective passage.

12. The display sign of claim 1, wherein said sign panel has oppositely disposed planar display sides.

13. The display sign of claim 1, wherein said corrugated sheet material is formed of resilient polyethylene.

14. A display sign comprising:

a sign panel having at least two channels extending therethrough;

a post member comprising a U-shaped member with a pair of legs and a rounded end portion, each of said legs extending through a respective channel in said panel; and a base member formed with an elongated web and having a pair of passages extending longitudinally therethrough, a pair of longitudinal slots in said web, each slot intersecting a respective passage along the longitudinal extent thereof whereby the legs of said post member are adapted to be inserted through said slots and into said passages.

15. The display sign of claim 14, wherein said sign panel is formed of corrugated sheet material, said post member being formed of a wire having a circular cross-section, said base member being formed of extruded polyethylene.

16. The display sign of claim 14, wherein said base member comprises a central web with side edges, a pair of generally C-shaped ribs integrally formed along the side edges of said central web, said passages and slots being formed in said ribs.

17. The display sign of claim 14, wherein said legs extend through said sign panel and project therefrom a given distance, said base member having a length less than said given distance whereby said legs are adapted to be driven into the ground until said base member is compressed between the ground and the sign panel.

18. The display sign of claim 14, wherein said sign panel is formed of corrugated polyethylene sheet material.

* * * * *